US005185043A

United States Patent [19]

Nishike et al.

[11] Patent Number: 5,185,043

[45] Date of Patent: Feb. 9, 1993

[54] METHOD FOR PRODUCING LOW IRON LOSS GRAIN ORIENTED SILICON STEEL SHEETS

[75] Inventors: Ujihiro Nishike; Shigeko Sujita; Tsuneo Nagamine, all of Chiba, Japan

[73] Assignee: Kawasaki Steel Corporation, Japan

[21] Appl. No.: 609,007

[22] Filed: Oct. 31, 1990

Related U.S. Application Data

[63] Continuation of Ser. No. 287,857, Dec. 21, 1988, abandoned.

[30] Foreign Application Priority Data

Dec. 26, 1987 [JP] Japan ..... 62-328420

[51] Int. Cl.[5] ..... H01F 1/04

[52] U.S. Cl. ..... 148/111; 148/113

[58] Field of Search ..... 148/110, 111, 113

[56] References Cited

U.S. PATENT DOCUMENTS 4,750,949 6/1988 Kobayashi et al. ..... 148/111

FOREIGN PATENT DOCUMENTS 0143548 6/1985 European Pat. Off. .
0229646 7/1987 European Pat. Off. .
2206687 6/1974 France .
57-89433 6/1982 Japan ..... 148/111
2167324 5/1986 United Kingdom ..... 148/111
2168626 6/1986 United Kingdom .

OTHER PUBLICATIONS

Patent Abstracts of Japan vol. 10 No. 245 (C-368) 2301 Aug. 22, 1986.
Patent Abstracts of Japan vol. 11 No. 81 (E-488) 2528 Mar. 12, 1987.
Patent Abstracts of Japan vol. 6 No. 7 C-87 885 Jan. 6, 1982.

*Primary Examiner*—John P. Sheehan
*Attorney, Agent, or Firm*—Austin R. Miller

[57] ABSTRACT

A grain oriented silicon steel sheet having a low iron loss and not causing degradation of properties even through strain relief annealing is produced by applying ultrasonic vibrations to the surface of the sheet after secondary recrystallization annealing.

8 Claims, 9 Drawing Sheets

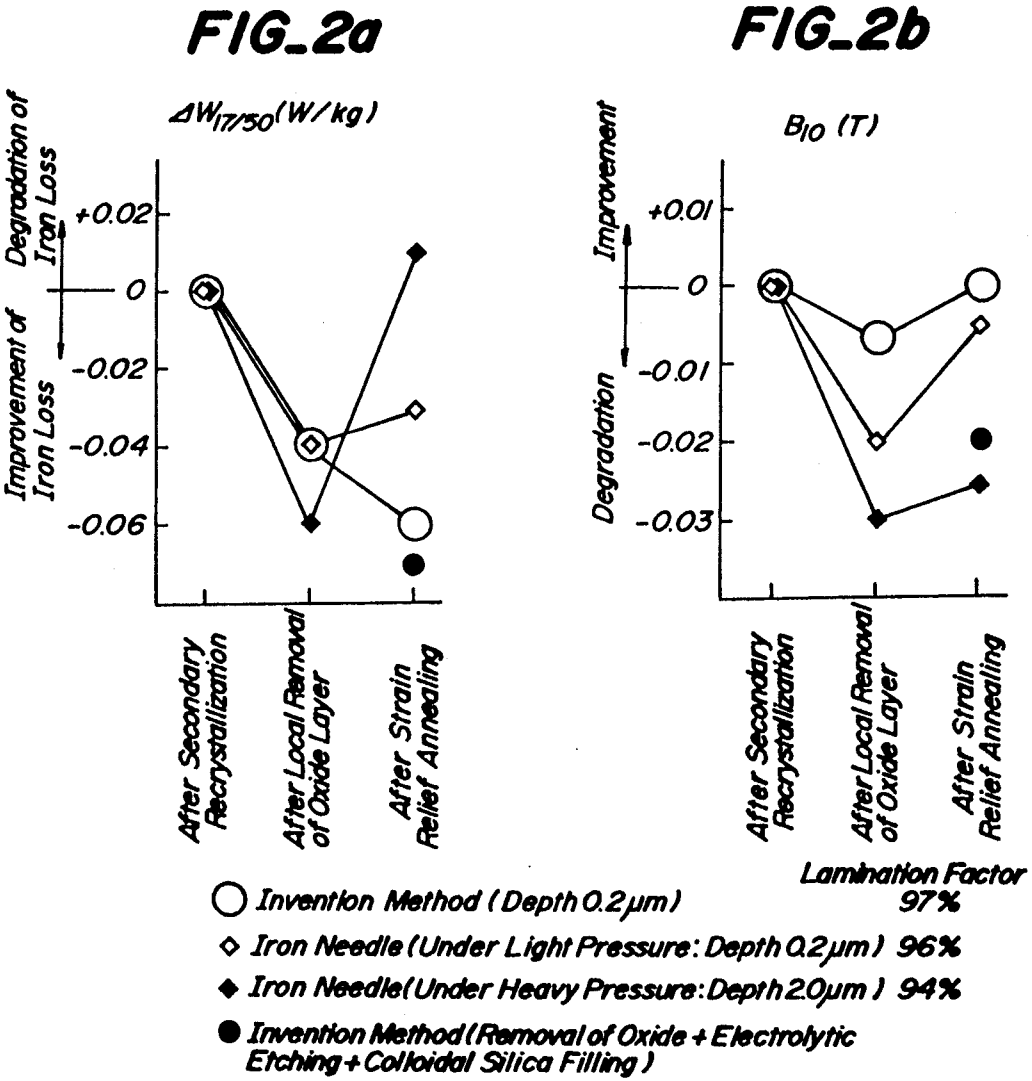
FIG_2a
$\Delta W_{17/50}$ (W/kg)
+0.02
0
-0.02
-0.04
-0.06
Improvement of Iron Loss
Degradation of Iron Loss
After Secondary Recrystallization
After Local Removal of Oxide Layer
After Strain Relief Annealing
FIG_2b
$B_{10}$ (T)
+0.01
0
-0.01
-0.02
-0.03
Improvement
Degradation
After Secondary Recrystallization
After Local Removal of Oxide Layer
After Strain Relief Annealing
Lamination Factor 97%
○ Invention Method (Depth 0.2μm)
◇ Iron Needle (Under Light Pressure: Depth 0.2μm) 96%
◆ Iron Needle (Under Heavy Pressure: Depth 20μm) 94%
● Invention Method (Removal of Oxide + Electrolytic Etching + Colloidal Silica Filling)

METHOD FOR PRODUCING LOW IRON LOSS GRAIN ORIENTED SILICON STEEL SHEETS

This application is a continuation of application Ser. No. 287,857, filed Dec. 21, 1988 now abandoned.

BACKGROUND OF THE INVENTION

1. Field of the Invention

This invention relates to a method of producing a low iron loss grain oriented silicon steel sheet not having its properties degraded by strain relief annealing, and more particularly to an improvement of iron loss value in a grain oriented silicon steel sheet after secondary recrystallization annealing without having its secondary recrystallization annealing, which can be realized by imparting non-uniformity to an oxide layer formed on the surface of the sheet to provide regions acting under different tensions or to provide magnetically different regions on the surface.

2. Related Art Statement

Grain oriented silicon steel sheets are mainly utilized as cores for transformers and other electrical machinery and equipment, and are required to have excellent magnetic properties, particularly a low iron loss (represented by the $W_{17/50}$ value).

For this purpose, it is demanded to highly align the <001> orientation of secondary recrystallized grains in the silicon steel sheet into the rolling direction and to reduce impurities and precipitates existent in the steel of the final product as far as possible.

Under the above circumstances, there have been attempted great efforts for improving the properties of grain oriented silicon steel sheets up to the present. As a result, the iron loss value has also improved from year to year. Recently, a $W_{17/50}$ value of 1.05 W/kg was obtained in a product having a thickness of 0.30 mm.

However, it is strongly demanded to develop electrical machinery and equipment having less power loss in view of the energy crisis existing since several years ago. In this connection, grain oriented silicon steel sheets having a lower iron loss are demanded as a core material.

As a general means for reducing the iron loss of the grain oriented silicon steel sheet, there are mainly known metallurgical means, such as increasing the Si content, decreasing the product thickness, fining of secondary recrystallized grains, reducing impurity contents, highly aligning secondary recrystallized grains into {110}<001> orientation and the like. These metallurgical means already reach to a limit in view of the existing production process, so that it is very difficult to attain an improvement of the properties exceeding the existing values. If any improvement is realized, the actual effect of improving the iron loss is slight for the effort.

Apart from the above general means, Japanese Patent Application Publication No. 54-23647 proposes a method of fining secondary recrystallized grains by forming secondary recrystallization inhibiting regions on the steel sheet surface. In this method, however, the control of secondary recrystallized grain size is unstable, so that such a method can not be said to be practical.

In addition, Japanese Patent Application Publication No. 58-5968 proposes a technique for reducing the iron loss in which a microstrain is introduced into the surface portion of the steel sheet after the secondary recrystallization by pushing a small ball of the type used in a ballpen to the steel sheet surface to conduct refinement of magnetic domains, and Japanese Patent Application Publication No. 57-2252 proposes a technique for reducing the iron loss in which a laser beam is irradiated at intervals of several mm onto the surface of the final product in a direction perpendicular to the rolling direction to introduce high dislocation density regions into the surface portion of the sheet and conduct refinement of magnetic domains. Further, Japanese Patent laid open No. 57-188810 proposes a technique of reducing the iron loss in which a microstrain is introduced into the surface portion of the steel sheet by discharge working to conduct refinement of magnetic domains.

All of these methods are designed to reduce the iron loss by introducing a micro plastic strain into the surface portion of the base metal in the steel sheet after secondary recrystallization to provide refinement of magnetic domains, and are evenly practical and have an excellent effect of reducing the iron loss. However, the effect obtained by the introduction of plastic strain in these methods is undesirably reduced by strain relief annealing after the punching, shearing work, coiling or the like of the steel sheet or by subsequent heat treatment such as baking of the coating layer or the like.

In Japanese Patent laid open No. 61-73886, there is proposed a technique for reducing the iron loss in which a non-uniform elastic strain is given to the steel sheet surface by locally removing a surface coating through a vibrating body forcedly performing reciprocal movement at a moving quantity of not less than $5\times10^{-6}$ kg m/s. Even in this technique, however, the effect is largely lost by annealing at a temperature above 600° C.

Moreover, when the introduction of micro plastic strain is carried out after the coating treatment, a reapplication of insulative coating should be carried out for maintaining the insulation property, so that the number of steps of the process significantly increases, resulting in rise of cost.

In order to solve the above drawbacks of the conventional techniques, the formation of deficient portions on forsterite film is proposed in Japanese Patent laid open No. 60-92481.

There are described two methods for the formation of deficient portions in the above publication, one being a method of locally forming no forsterite portion and the other being a method of locally forming the deficient portions after the formation of forsterite. Among them, the method of locally removing forsterite is an actually industrial and useful method because in the method of locally forming no forsterite portion, the process control is difficult due to the use of chemical means or means for obstructing the reaction.

On the other hand, as the means for locally removing forsterite after the secondary recrystallization or forsterite formation, there are disclosed chemical polishing, electrolytic polishing, mechanical method of using a rotational disc-like grindstone or an iron needle under a light pressure, and further an optical method using an output-adjusted laser beam or the like. These methods exhibit an effect to a certain extent, respectively. However, the chemical polishing and electrolytic polishing become considerably high in cost. In the use of the rotational disc-like grindstone, it is difficult to control the position following to the disc height in accordance with the surface properties, so that this is unsuitable for industrial production. Moreover, the optical method using the laser beam or the like becomes high in cost.

On the other hand, the use of an iron needle under light pressure is low in cost, but is difficult to control to remove only forsterite and also removes a part of the surface portion of the base metal together with forsterite. As a result, upheaving of the base metal is caused at both sides of the removed portion or deficient portion to considerably lower the lamination factor and the like. That is, the use of the iron needle is difficult to industrially put into practical use.

As a technique for the refinement of magnetic domains, the formation of grooves in the surface of the silicon steel sheet is disclosed in Japanese Patent Application No. 50-35679, and in Japanese Patent laid open Nos. 59-28525, 59-197520, 61-117218 and 61-117284 and is a well-known technique. Since this technique utilizes a phenomenon of magnetic domain refinement through diamagnetic field in the groove space, however, there are many drawbacks that the magnetic flux density (represented by $B_{10}$ value) is largely decreased, and the mechanical properties are degraded and the lamination factor is considerably decreased in accordance with the groove form though the above technique is durable to the strain relief annealing.

SUMMARY OF THE INVENTION

It is, therefore, an object of the invention to provide a method for the production of low iron loss grain oriented silicon steel sheets which can provide a sheet having good surface properties in the lamination without greatly decreasing not only the $B_{10}$ value but also the lamination factor, and which does not cause degradation of magnetic properties, particularly iron loss properties during strain relief annealing, and easily performs the actual operation without decreasing efficiency.

According to the invention, there is the provision of a method of producing a low iron loss grain oriented silicon steel sheet not causing degradation of properties through strain relief annealing, characterized in that ultrasonic vibrations are applied to a surface of a grain oriented silicon steel sheet after secondary recrystallization annealing to locally remove an oxide layer from the surface of the sheet. Thus, the effect of magnetic domain refinement can be stably and cheaply obtained without greatly decreasing the $B_{10}$ value and the lamination factor and obliterating the effect of reducing the iron loss through strain relief annealing.

In the method of the invention, a working tip of an ultrasonic vibrating member is pushed onto the surface of the sheet under a controlled pressure. According to a preferred embodiment of the invention, a head portion of an apparatus for generating ultrasonic vibrations is arranged opposite to the surface of a sheet extending and running about a roller so as to move in the widthwise direction of the sheet a plurality of ultrasonic vibrating members are arranged in the head portion in a staggered form so as to move toward and away from the surface of the sheet. When the ultrasonic vibrating member is moved toward the sheet surface, the working tip of this member is pushed to the sheet surface under a controlled pressure. At such a state, the head portion is reciprocatedly moved in the widthwise direction of the running sheet, whereby ultrasonic vibrations are applied to the sheet of the grain oriented silicon steel sheet to locally remove the oxide layer such as forsterite or the like produced by the secondary recrystallization from the sheet surface.

The shape of the working tip for applying ultrasonic vibrations to the surface of the grain oriented silicon steel sheet after secondary recrystallization annealing may be plate-like or needle-like as far as the oxide layer can locally be removed. Further, the material of the working tip may be a hard crystal such as diamond, ruby and the like; ceramics; metals such as brass, copper and the like, grindstone, wood piece or the like.

The frequency of the ultrasonic vibration is desirably not less than 10 kHz.

BRIEF DESCRIPTION OF THE DRAWINGS

The invention will be described with reference to the accompanying drawings, wherein:

FIGS. 2*a* and 2*b* are graphs showing the effect of improving magnetic properties, respectively;

DESCRIPTION OF THE PREFERRED EMBODIMENTS

According to the invention, the oxide layer is effectively and locally broken and removed from the surface of the grain oriented silicon steel sheet by the shock of ultrasonic vibrations, so that it is not required to apply a large load as described in Japanese Patent laid open No. 61-117218 relating to the technique of locally forming grooves as the conventional magnetic domain refinement. That is, when ultrasonic vibrations are applied to the surface of the grain oriented silicon steel sheet, the working tip of the ultrasonic vibrating member is pushed to the sheet surface under a pressure of not more than 40 kg/mm$^2$. Because, when the pressure exceeds the above value, a plastic strain is given to the surface portion of the base metal, and also the lamination factor is decreased and the working tip is considerably worn due to the upheaving of the base metal around the removed portion of the oxide layer.

Further, according to the invention, a large plastic strain as described in the conventional technique of forming grooves by using an iron needle is not given to the surface of the base metal and it is not required to form a deep groove in the base metal, so that there are never caused any large decreases of $B_{10}$ value or degradations of mechanical properties.

There will be described the form of a worked track after the removal of oxide layer by applying ultrasonic vibrations according to the invention, wherein the working tip of the ultrasonic vibrating member is made from a ruby, and by using an iron needle under a slightly light pressure as a comparative example below.

Figure 1A:
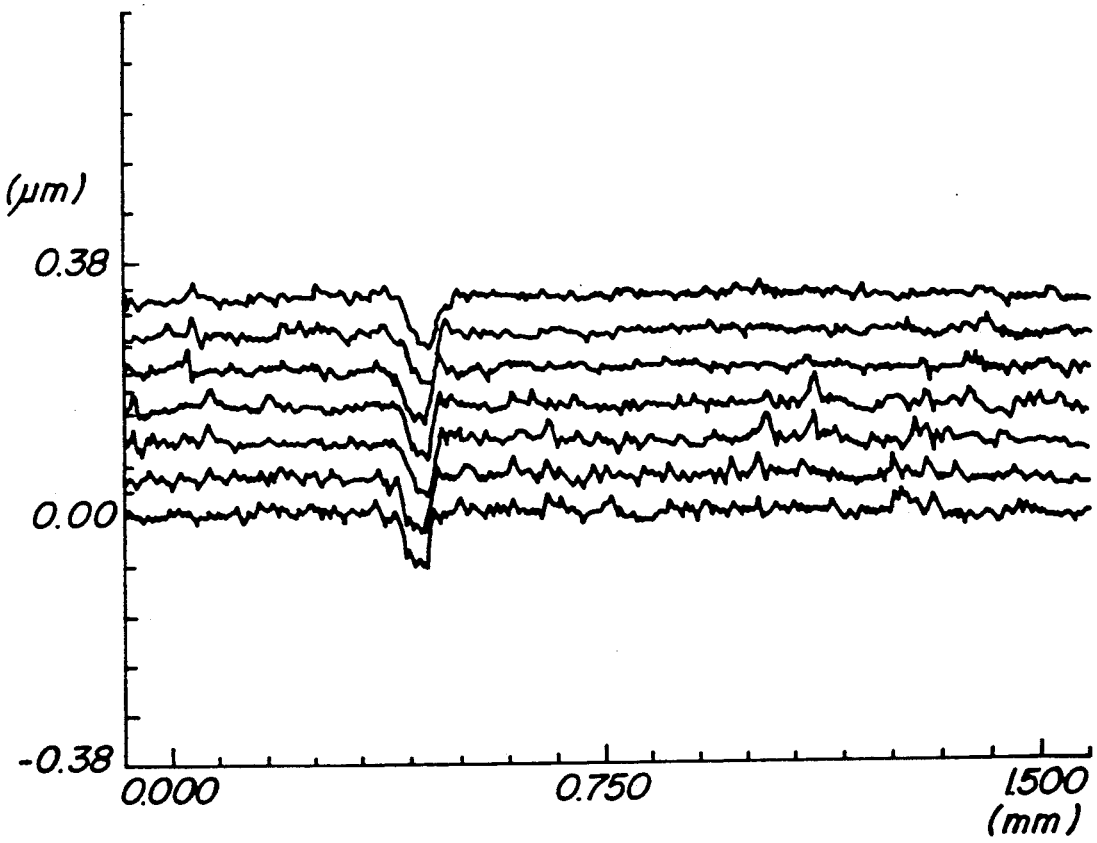
FIGS. 1*a* and 1*b* are charts showing locally removed tracks of oxide layer as measured by means of a three dimensional roughness meter, respectively.
Figure 1B:
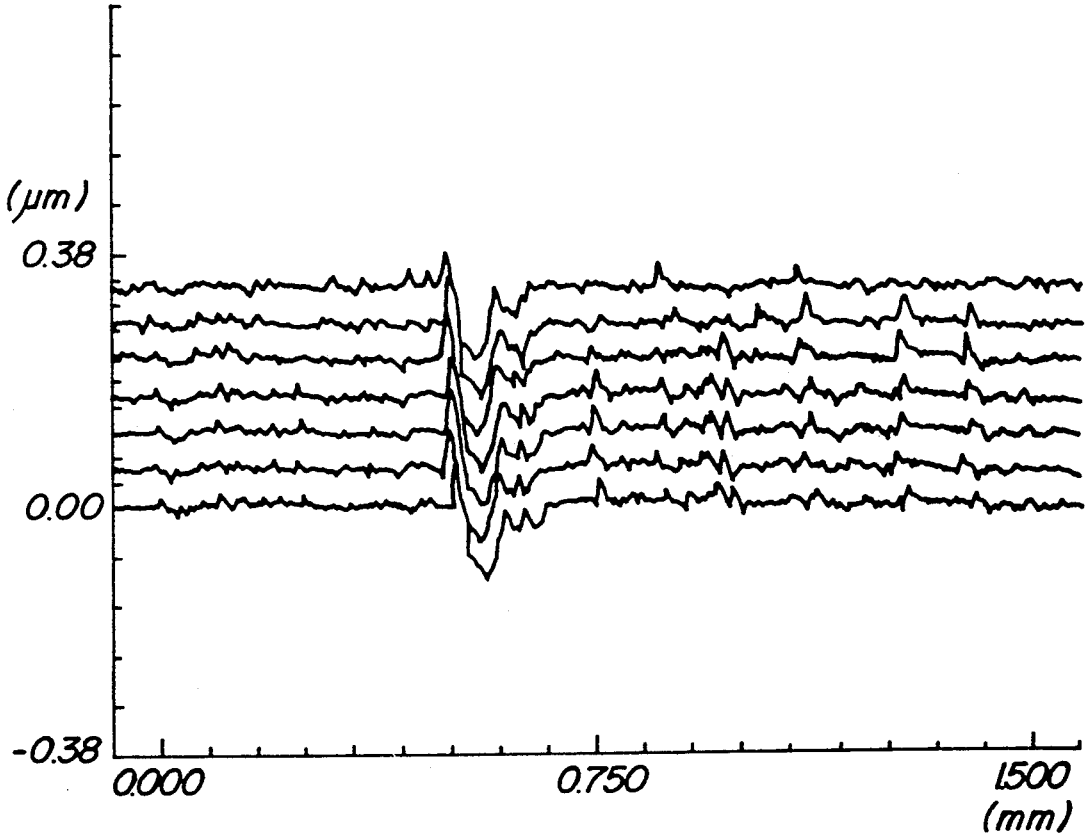

FIGS. 1*a* and 1*b* the locally removed portions of the oxide layer as measured by means of a three dimensional roughness meter.

FIG. 1*a* is a case of applying ultrasonic vibrations, while FIG. 1*b* is a case of using an iron needle under a light pressure.

As seen from FIGS. 1*a* and 1*b*, the depth of the removed portion in both cases is a few tenth um, from which it is apparent that deep grooves are not formed in the base metal. However, when the oxide layer is mechanically removed by the iron needle, though the removed portion or groove is not so deep, the base metal upheaves around the groove as seen from the left-side edge of the groove in FIG. 1*b*. Such an upheaving of the base metal not only brings about a degradation of illumination factor in the electromagnetic steel sheet laminate, but also results in insulation breakage, so that its effectiveness as an industrial product is lost. On the contrary, according to the invention, upheaving of the base metal is not caused as seen from FIG. 1*a*. That is, it is clear that the application of ultrasonic vibration has effects in addition to the decreasing of the pushing pressure at the working tip.

The improvement of magnetic properties according to the invention is shown by the mark O in FIG. 2 together with a case (◇) of removing the surface coating with the iron needle and a case (♦) of forming the groove as comparative examples.

According to the method of the invention, the oxide layer was locally removed from the surface of the grain oriented silicon steel sheet after secondary recrystallization annealing by applying ultrasonic vibrations of 30 kHz to a working diamond tip to form grooves each having a width of 80 um and a depth of 0.21 um at a spacing of 5 mm onto the sheet surface in parallel to each other in a direction perpendicular to the rolling direction of the sheet.

On the other hand, when a steel scribe as an iron needle was used under light pressure, grooves having a depth of 0.2 um were formed at a spacing of 5 mm in parallel to each other, while when the steel scribe was used under heavy pressure, grooves having a depth of 2 um (width 120 um) were formed at a spacing of 5 mm in parallel to each other. In the latter method, the formation of the groove having a depth of 2 um results in the application of heavy pressure to the base metal. As a result, the iron loss is considerably reduced before strain relief annealing in the use of an iron needle under heavy pressure, but it is inversely degraded after strain relief annealing. This is because strain is introduced into the base metal by the force applied for the formation of a groove having a depth of 2 um to conduct the refinement of magnetic domain, so that the iron loss is reduced once, but such an effect of reducing the iron loss is lost by the subsequent strain relief annealing (800° C. × 3 hours). In this case, the decrease of $B_{10}$ value is large, so that the iron loss value is poor as compared with the iron loss value just after the secondary recrystallization annealing. Furthermore, the forsterite layer in the vicinity of the groove is non-uniformly broken under heavy pressure, so that the effect of magnetic domain refinement by the removal of an oxide layer such as forsterite or the like (which is also executed by the method of the invention) is substantially lost and hence the iron loss is largely degraded.

When the local removal of oxide layer up to a depth of 0.2 um is carried out by the method of the invention, the improving ratio of iron loss before and after the removal of oxide layer is small as compared with the case of forming a groove under heavy pressure, but the degradation of iron loss is not caused after strain relief annealing and an improving tendency is rather caused. Though the reason for such an improvement is not clear, it is considered that any unnecessary strain slightly introduced by the application of ultrasonic vibrations is caused to disappear by strain relief annealing or the oxide layer formed advantageously acts to the improvement of iron loss.

When the oxide layer is removed to a depth of 0.2 um by an iron needle under light pressure, a degradation of the iron loss and magnetic flux density is caused after the strain relief annealing. This is considered due to the fact that the leakage of magnetic flux becomes large by the upheaving of base metal at the worked portion.

In Japanese Patent laid open No. 56-130454, there is disclosed a technique wherein an ultrasonic wave is applied to a gear-like roll and the roll is linearly contacted to the surface of the grain oriented silicon steel sheet after secondary recrystallization annealing under a pressure in order to form fine recrystallized grain groups on the sheet surface. This technique is designed to give complicated strain to the sheet surface for obtaining fine recrystallized grains. Therefore, it is naturally required to apply a strain which is enough to enable the recrystallization, and consequently a gear roll is used.

On the contrary, this invention is designed to locally break and remove the oxide layer, which is entirely different from the formation of fine recrystallized grains. For this purpose, a working tip of needle-like or plate-like form is used. As a result, the recrystallized grain groups are not newly formed in the method of the invention.

In a preferred embodiment of the invention, the sheet is subjected to electrolytic etching after the local removal of the oxide layer. Thus, the effect of magnetic domain refinement can be even more improved by utilizing a diamagnetic field at a groove formed after the local removal of the oxide layer. In another embodiment of the invention, a foreign substance is introduced into the grooves after electrolytic etching to further improve the magnetic properties as shown by mark • in FIGS. 2*a* and 2*b*. Of course, the significance of illumination factor is sufficiently held in these cases.

The results of the iron loss and $B_{10}$ value in these preferred embodiments are also shown by the mark • in FIGS. 2*a* and 2*b*, from which it is apparent that the iron loss is further reduced but the $B_{10}$ value is somewhat degraded. Such measured data are obtained when the sheet is subjected to local removal of oxide layer, electrolytic etching in an NaCl aqueous solution (100 g/ ) at a current density of 20 A/dm$^2$ for 5 seconds, filling with colloidal silica and strain relief annealing (800° C. ×3 hours).

According to the invention, the starting material is required to be a grain oriented silicon steel sheet after secondary recrystallization annealing. That is, the case of applying the method of the invention to the sheet before secondary recrystallization annealing is meaningless, but when the method of this invention is applied to the sheet after secondary recrystallization annealing, it develops an effect irrespective of the previous history of the sheet such as the kind of inhibitor, cold rolling number or the like.

Since secondary recrystallization annealing is usually carried out at a temperature of 800° ~ 1200° C., an oxide layer is present on the surface of the grain oriented silicon steel sheet.

According to the invention, this oxide layer is locally removed by applying ultrasonic vibrations. In this case, the working tip of the ultrasonic vibrating member is contacted with the sheet surface under a pressure of not more than 40 kg/mm$^2$ at the time of applying ultrasonic vibrations in order to follow the working tip to the sheet surface. When the pressure exceeds this value, a plastic strain is undesirably generated at the surface portion of the sheet.

The effect achieved by the local removal of the oxide layer is usually unchangeable before or after the formation of insulation coating onto the oxide layer. In this case, the insulation coating may be a tension coating.

It is desired that the local removal of the oxide layer is carried out in dotted line form or continuous or discontinuous linear form across the rolling direction to repeatedly form the removed portions in parallel to each other on the sheet surface. Preferably, the removing direction is perpendicular to the rolling direction. The spacing between parallel removed portions is preferred to be within a range of 1 ~ 30 mm. When the spacing between parallel removed portions is less than 1 mm, the surface properties are degraded by the resulting grooves and sufficient improvement of iron loss value is not obtained, while when it exceeds 30 mm, the effect of magnetic domain refinement is lost.

Further, the effect is substantially unchangeable even when the local removal is applied to either one-side surface or both-side surfaces of the sheet.

In the invention, the local removal of oxide layer must be carried out by using a working tip subjected to ultrasonic vibration. The shape of the working tip is desirably needle-like. The width of the removed portion can be varied by the size or thickness of the working tip. The width of the removed portion is 10-1000 μm, preferably about 100 μm. When the width of the removed portions is less than 10 μm, breaking of the sheet is apt to be caused by notch action, while when it exceeds 1000 μm, the surface properties are degraded and also improvement of iron loss value is not obtained. Since the ultrasonic vibrations are applied to the working tip in the local removal of oxide such as forsterite or the like, there are advantages that the working strain is small, the tool (working tip) is made small and a smooth surface without upheaving of the base metal is obtained.

When the local removal of oxide layer is mechanically carried out by using an iron needle without application of ultrasonic vibration, the plastic deformation portion becomes larger, resulting in a large decrease of illumination factor and $B_{10}$ value.

Vibrations having a frequency of not less than 10 kHz and an amplitude of not more than 50 μm and mainly containing a component in a particular direction to the sheet surface are preferable as a condition for the application of ultrasonic vibration. When the frequency is less than 10 kHz, the shock density by vibrations becomes small and the effect is less. On the other hand, when the amplitude is more than 50 μm, the shock force becomes large and a large strain is caused to decrease the $B_{10}$ value.

In this case, pulse or continuous mode is used as a generation mode of ultrasonic vibration.

As the working tip for applying ultrasonic vibrations to the sheet surface, use may be made of any materials capable of locally removing the oxide layer, but the use of diamond, ceramics or super-hard alloy having a semi-ball or columnar shape of not more than 2 mm in diameter is preferable. Because, when the material is not hard, it is worn to change the removing means of the oxide layer and badly effects the magnetic domain refinement. And also, a semicircular shape having a diameter of more than 2 mm or other shape badly affects the magnetic domain refinement due to the wearing.

Figure 3:
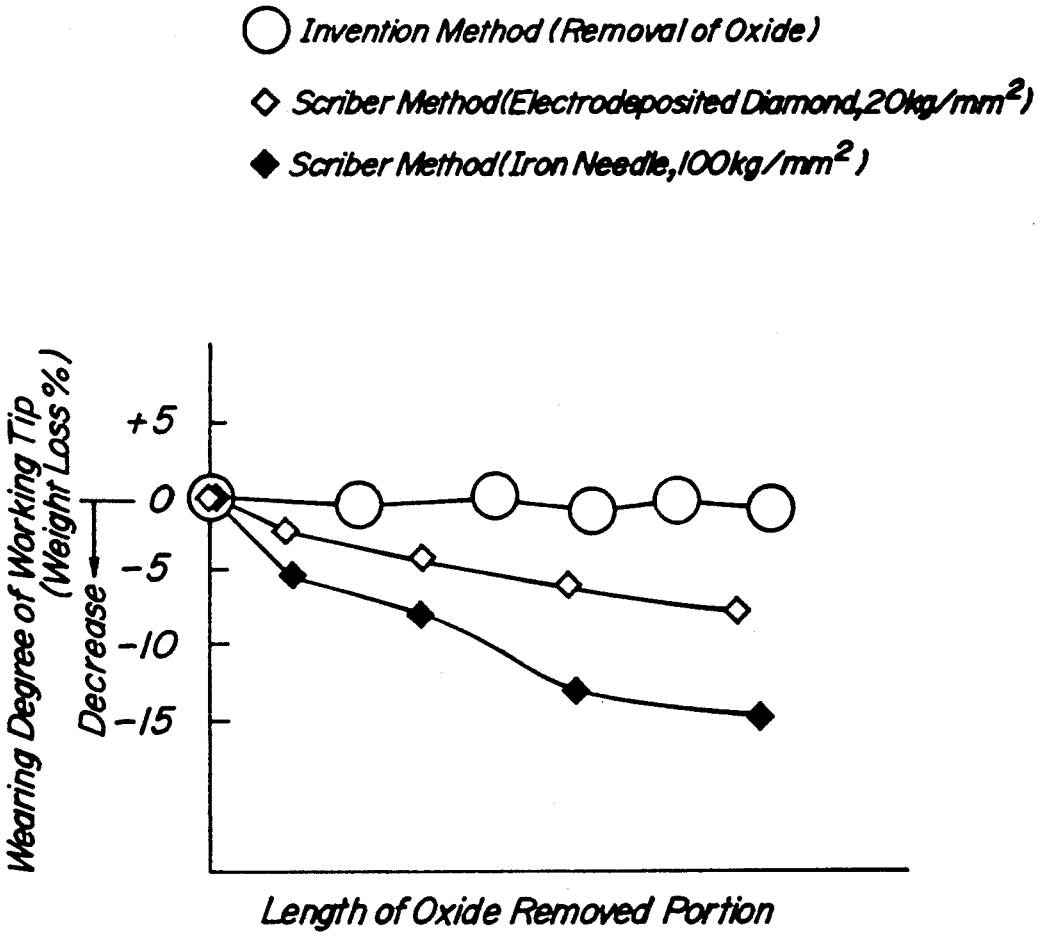
FIG. 3 is a graph showing wearing loss of the working tip by the local removal of the oxide layer.

FIG. 3 shows a wearing degree of the working tip together with results using the iron needle as a comparative example.

In the method of the invention, the oxide layer was locally removed from the surface of the steel sheet after secondary recrystallization annealing by applying ultrasonic vibrations of 30 kHz to the working tip of an electrodeposited diamond and moving the working tip under a load of 10 kg/mm$^2$ in a direction perpendicular to the rolling direction to form groove portions at a spacing of 5 mm parallel to each other.

On the other hand, the grooves were formed at a spacing of 5 mm parallel to each other by using a scribe of electrodeposited diamond under a load of 20 kg/mm$_2$ or a scribe iron needle under a load of 100 kg/mm$^2$ as a comparative example.

As seen from FIG. 3, the iron needle was largest in the wearing degree of working tip, while the electrodeposited diamond used in the application of ultrasonic vibration according to the invention had no weight loss, but the tip of the electrodeposited diamond used under a load of 20 kg/mm$^2$ was broken to reduce the weight, which badly affects oxide removal.

According to the invention, when electrolytic etching is carried out after the local removal of oxide layer by application of ultrasonic vibration, the iron loss can be further reduced. In this case, the etching depth of the groove is desirably not more than 20 μm.

Figure 4:
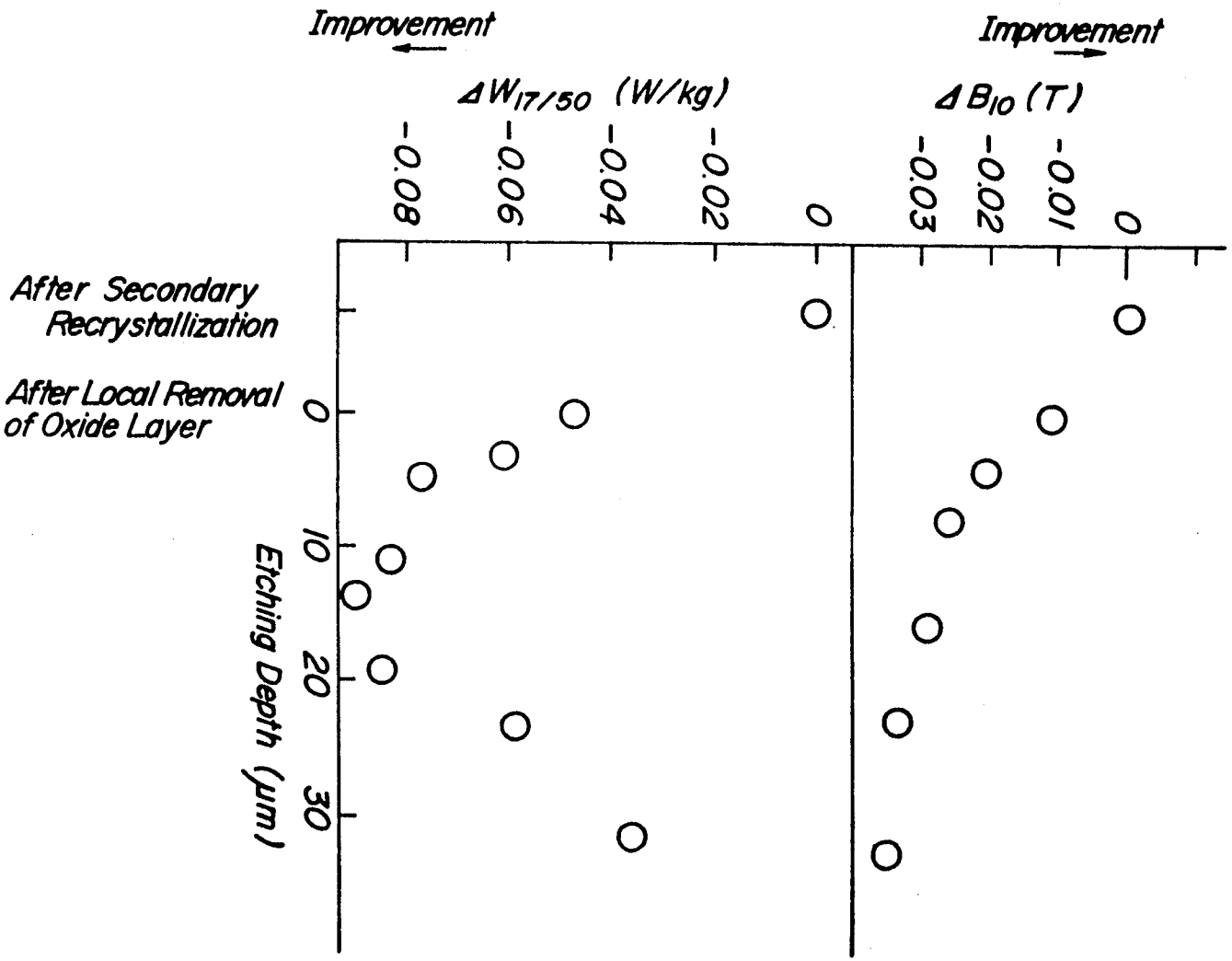
FIG. 4 is a graph showing the effect of improving magnetic properties through electrolytic etching.

FIG. 4 shows a relation between the etching depth after the local removal of oxide layer and the magnetic properties.

In this case, the local removal of oxide was carried out by applying ultrasonic vibrations having a frequency of 20 kHz and an amplitude of 15 μm to a super-hard working tip of 1.5 $\phi$ and forming grooves at a spacing of 8 mm in parallel to each other in a direction perpendicular to the rolling direction through this working tip. Then, the electrolytic etching was carried out in an aqueous solution of $NH_4Cl$-NaCl (100 g/l-100 g/l) at a current density of 5 A/dm$^2$, during which the etching depth was determined by varying the etching time. The effect of the etching on the magnetic properties is shown in FIG. 4.

The iron loss value is further improved when a substance locally producing a different tension based on the difference of thermal expansion coefficient or a magnetically different substance producing a diamagnetic field (for example, metal, silicate, phosphorus compound, oxide, nitride or the like) is filled as a foreign substance in the grooves produced by the electrolytic etching. In this case, it is desirable that the foreign substance has a thermal expansion coefficient smaller than that of the silicon steel sheet in order to obtain the different tension effect.

Figure 5:
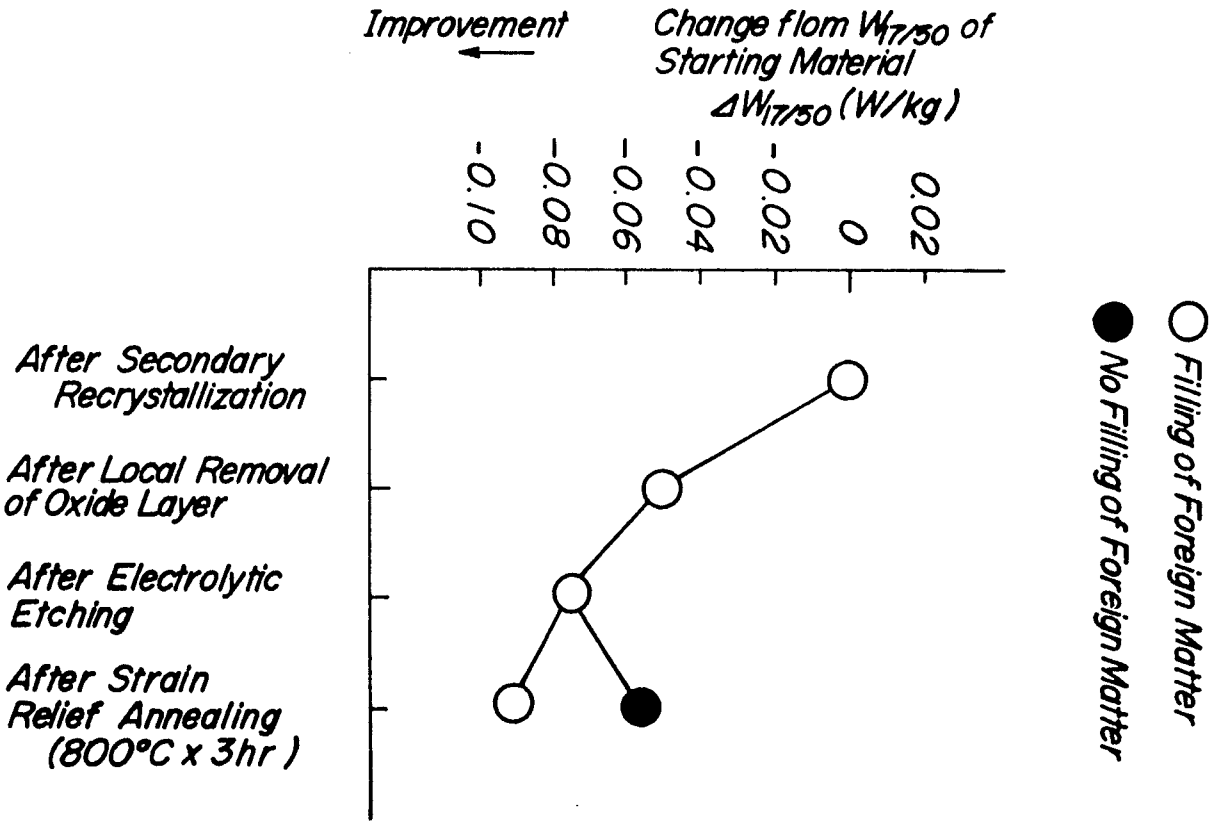
FIG. 5 is a graph showing the effect by filling of foreign substance.

FIG. 5 shows an effect of improving the iron loss value by filling with foreign substance. In this case, the groove having a depth of 10 μm was formed by the local removal of oxide and the electrolytic etching in the same manner as in FIG. 4. Thereafter, the groove was subjected to Sb plating and further to strain relief annealing at 800° C. for 3 hours.

The application of ultrasonic vibrations to the sheet surface according to the invention will be described in detail with reference to FIGS. 6 to 10.

Figure 6A:
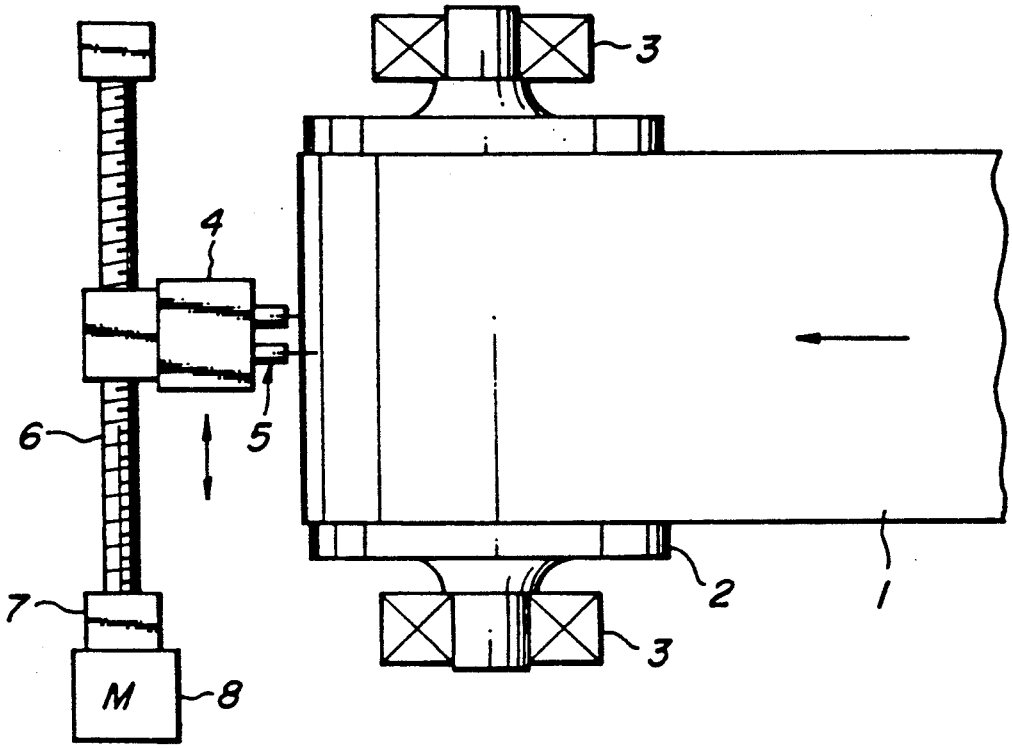
FIGS. 6*a* and 6*b* are plan view and side view of a first embodiment for practicing the method of the invention, respectively.
Figure 6B:
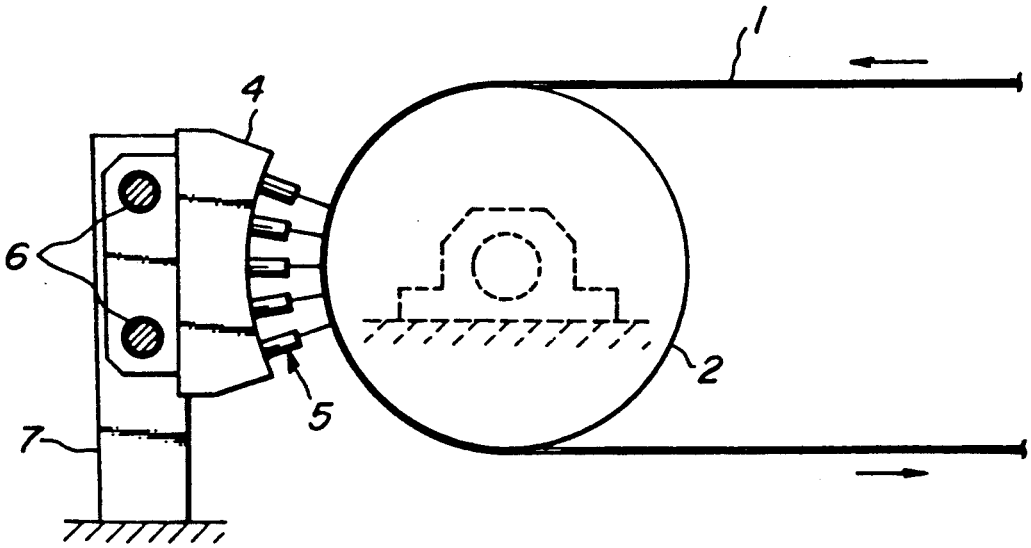

In FIGS. 6*a* and 6*b* is shown a first embodiment of the method according to the invention. A grain oriented silicon steel sheet 1 after secondary recrystallized annealing extends about a roller 2 supported by a bearing 3. On the other hand, a head an apparatus for generating ultrasonic vibrations is arranged in opposition to the surface of the running steel sheet around the roller 3 and is provided with plural ultrasonic vibrations is arranged in opposition to the surface of the running steel sheet around the roller 3 and is provided with plural ultrasonic vibrating members 5 staggeredly arranged in the up and down directions of the head portion 4. Further, the head portion 4 is reciprocatedly moved in the widthwise direction of the running steel sheet 1 through a screw 6 supported at both ends by bearings 7 and a motor 8.

Figure 8:
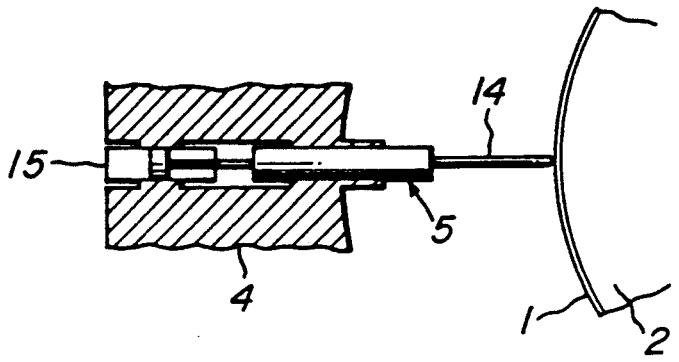
FIG. 8 is a partially enlarged sectional view of the ultrasonic vibrating member used in the invention.

The detail of the ultrasonic vibrating member 5 is shown in FIG. 8. Each of the ultrasonic vibrating members 5 staggeredly arranged in the head portion 4 is connected to an air cylinder 15 involved in or supported by the head portion 4 in such a manner that the ultrasonic vibrating member 5 is moved toward the surface of the running steel sheet 1 and away therefrom at both widthwise ends of the steel sheet by the action of the air cylinder 15 so as not to injure the surface of the roller 2. Further, the pushing pressure of working tip 14 to the steel sheet 1 can be controlled by adjusting the air pressure applied from the air cylinder 15 to the ultrasonic vibrating member 5.

Figure 9:
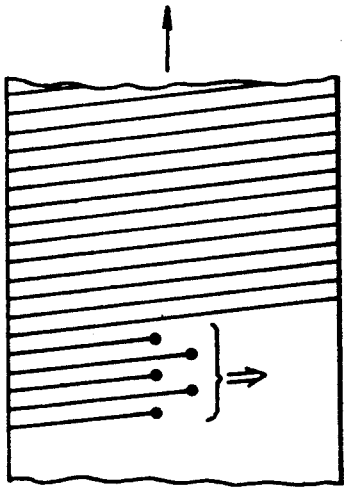
FIGS. 9 and 10 are schematic views showing the removing state of oxide layer from the surface of the steel sheet, respectively.

When the oxide layer is continuously and locally removed from the surface of the silicon steel sheet by applying ultrasonic vibrations through the apparatus shown in FIG. 6, the number of ultrasonic vibrating members 5 used and the moving speed of the head portion 4 are first determined so as to well balance the feeding speed of the steel sheet 1. In this case, the oxide removal is performed at the departing stage of the head portion, while the ultrasonic vibrating member is moved away from the sheet surface at the returning stage of the head portion. Such departing and returning stages of the head portion are continuously repeated to perform the local removal of oxide layer from the surface of the running steel sheet. The removed track of the oxide layer is shown in FIG. 9. Moreover, the removed track as shown in FIG. 10 can be obtained by intermittently feeding the steel sheet 1.

Figure 7A:
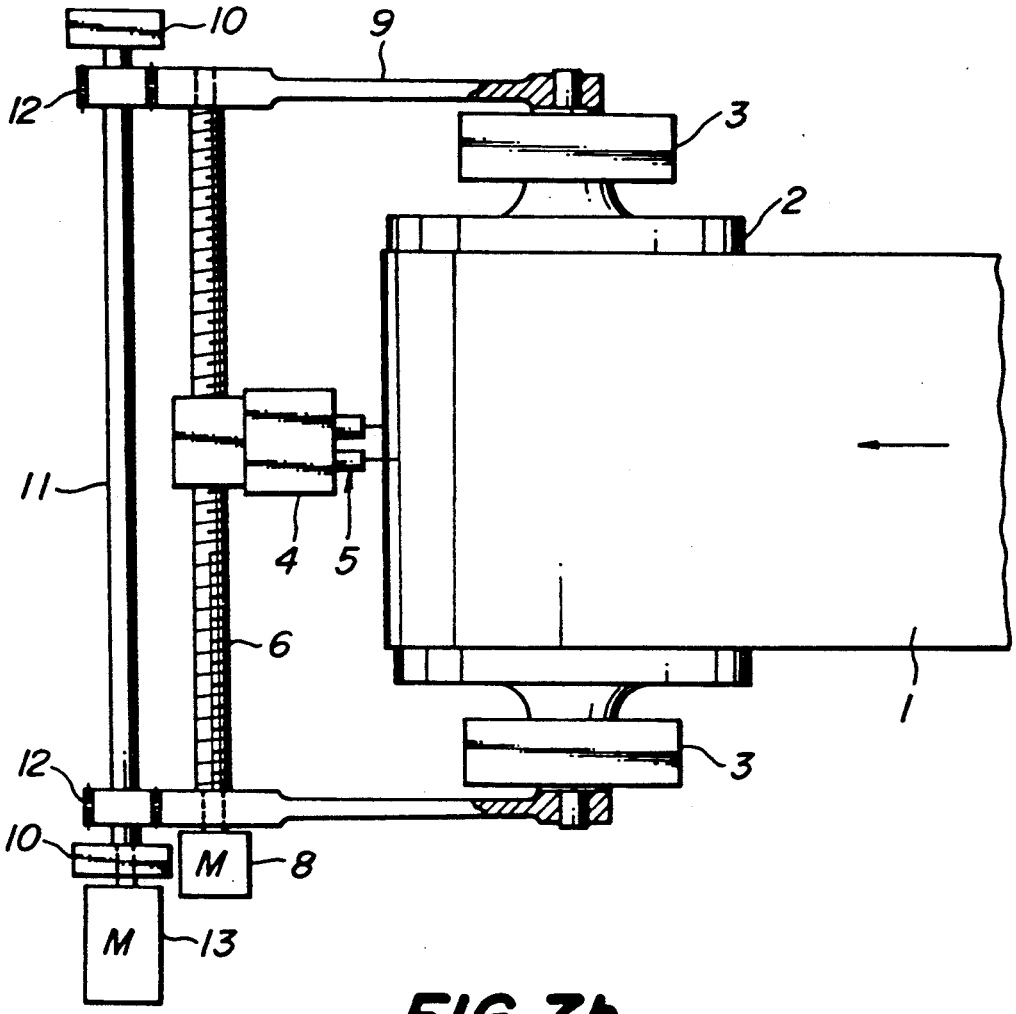
FIGS. 7*a* and 7*b* are plan view and side view of a second embodiment for practicing the method of the invention, respectively.
Figure 7B:
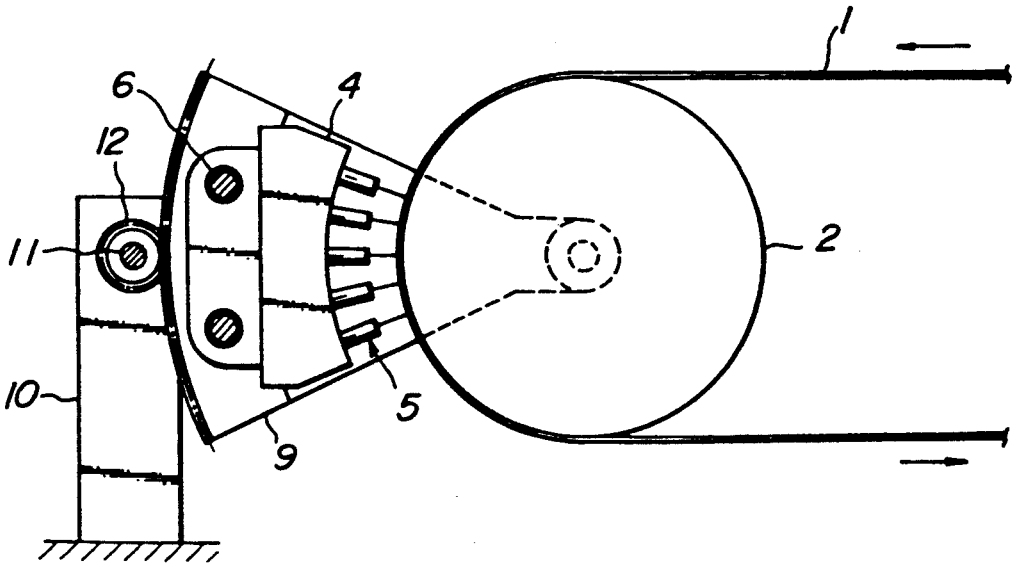
Figure 10:
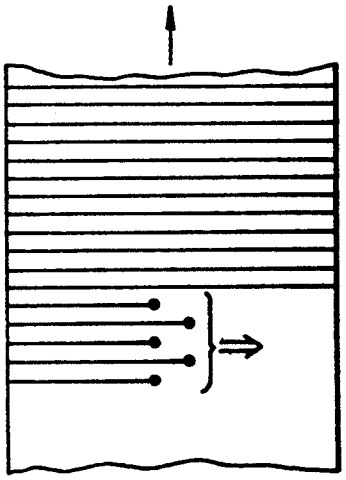

In FIGS. 7*a* and 7*b* is shown a second embodiment of the apparatus for locally removing an oxide layer from the surface of the grain oriented silicon steel sheet after the secondary recrystallization annealing by application of ultrasonic vibrations according to the invention, wherein the removed track as shown in FIG. 10 is obtained by continuously feeding the steel sheet.

As shown in FIGS. 7*a* and 7*b*, and end of an arm 9 is connected to each of bearings 3 located at both ends of the roller 2, and a segment gear is formed on the other end of the arm 9. This segment gear of the arm 9 is engaged with a pinion gear 12 of a pinion shaft 11 supported by a support 10 and connected to a driving motor 13. On the other hand, the screw shaft 6 supporting and moving the head portion 4 of the apparatus for generating ultrasonic vibrations is supported by the arm 9.

According to the above structure, the head portion 4 is moved in the running direction of the sheet or the peripheral direction of the roller 2 by synchronizing the engaging movement between the segment gear and the pinion gear with the feeding speed of the sheet by the driving motor 13, and at the same time the head portion 4 is moved in the widthwise direction of the sheet by the driving motor 8, whereby the removed track can be formed in a direction perpendicular to the running direction of the sheet as shown in FIG. 10.

In any case, as the number of the ultrasonic vibrating members used increases, the efficiency in the formation of removed track (productivity) becomes naturally excellent. Moreover, in case of using the apparatus of FIG. 6, the formation of the removed track is attained only at the departing stage for the movement of the head portion 4 because if the formation of the removed track is also performed at the returning stage, the slant of the removed track is just opposite to that formed at the departing stage and the parallel tracks can not be formed on the sheet surface. However, when the feeding of the sheet is intermittently stopped, the formation of removed track can be carried out even at the returning stage. On the other hand, in case of using apparatus of FIG. 7, the formation of the removed track as shown in FIG. 10 can be achieved at both stages while continuously feeding the sheet. Therefore, the latter apparatus has double the production efficiency as compared with the former apparatus when the number of the ultrasonic vibrating members and the feeding speed of the sheet are the same. In other words, the number of ultrasonic vibrating members in the latter apparatus can be reduced to half in the former apparatus.

The working tip 14 of the ultrasonic vibrating member 5 may be made from diamond, ruby, brass, steel, grindstone or the like as previously mentioned. Further, the frequency of vibrations to be applied is not less than 20 kHz, preferably 25–50 kHz, and the pushing pressure of the working tip is not more than 40 kg/mm$^2$. The working tip 14 of the ultrasonic vibrating member 5 can easily be inclined to the front in the running direction of the sheet.

The spacing between the adjoining ultrasonic vibrating members is preferably about 5 mm. The diameter of the roller 2 is not less than 300 mm for giving no bending strain to the sheet and may be properly determined together with the number of the ultrasonic vibrating members and the feeding speed of the sheet. As the material of the roller, steel, rigid rubber and the like are suitable. In case of the rigid rubber, the hardness is preferably not less than 60 (Hs).

The following examples are given in illustration of the invention and are not intended as limitations thereof.

EXAMPLE 1

A hot rolled sheet of silicon steel containing Si:3.27 wt % (hereinafter shown by % simply), Mn:0.070%, Se:0.019% and Sb:0.020% was subjected to two-times cold rolling through an intermediate annealing at 950° C. to obtain a cold rolled sheet having a final thickness of 0.23 mm.

Thereafter, the cold rolled sheet was subjected to decarburization and primary recrystallization annealing at 800° C. in a wet hydrogen atmosphere, coated at its surface with a slurry of an annealing separator consisting mainly of MgO and coiled, which was subjected to a secondary recrystallization annealing in a box furnace at 850° for 50 hours and further to a purification annealing in a dry hydrogen atmosphere at 1200° C. for 10 hours.

After excessive annealing separator was merely removed from the sheet surface, the sheet was treated under conditions as shown in the following Table 1.

The iron loss $W_{17/50}$ (W/kg) of the thus obtained sheet was measured to obtain results as shown in Table 1.

hydrogen atmosphere, coated at its surface with a slurry of an annealing separator consisting mainly of $Al_2O_3$ and coiled, which was subjected to a secondary recrystallization annealing in a box furnace at 850° C. for 50 hours and further to a purification annealing in a dry hydrogen atmosphere at 1200° C. for 10 hours.

After the removal of the annealing separator, an insulation coating was formed on the sheet surface, which was then subjected to a flat annealing. Then, the thus treated sheet was subjected to a treatment for locally removing the oxide layer under conditions as shown in the following Table 2. Next, the sheet was subjected to an electrolytic etching in an aqueous solution of NaCl (100 g/l) at a current density of 30 A/dm, for 10 seconds and further to an insulation coating with a phosphate.

The iron loss $W_{17/50}$ (W/kg) of the thus obtained sheets was measured to obtain results as shown in Table 2. Moreover, the standard sheet after the flat annealing had $B_{10}=1.9$ T and $W_{17/50}=0.95$ W/kg.

TABLE 1

| | | Local removing treatment of oxide layer | | | | Iron loss value after treatment | Magnetic properties after the formation of insulation coating and the annealing at 800° C. for 2 hours | | Lamination factor |
|---|---|---|---|---|---|---|---|---|---|
| | | Generation mode of ultrasonic vibration* | Working tip | Working pitch (mm) | Working mode | $W_{17/50}$ (W/kg) | $W_{17/50}$ (W/kg) | $B_{10}$ (T) | (%) |
| 1 | Acceptable Example | continuous | Electrodeposited diamond | 10 | linear | 0.86 | 0.85 | 1.90 | — |
| 2 | Acceptable Example | pulse | Electrodeposited diamond | 10 | " | 0.86 | 0.85 | 1.90 | — |
| 3 | Acceptable Example | pulse | grindstone | 10 | " | 0.87 | 0.86 | 1.90 | — |
| 4 | Acceptable Example | pulse | Electrodeposited diamond | 5 | " | 0.85 | 0.83 | 1.91 | 97 |
| 5 | Acceptable Example | continuous | ruby | 10 | " | 0.85 | 0.83 | 1.91 | — |
| 6 | Acceptable Example | continuous | " | 10 | " | 0.86 | 0.84 | 1.91 | — |
| 7 | Acceptable Example | continuous | " | 5 | " | 0.86 | 0.83 | 1.90 | 97 |
| 8 | Acceptable Example | pulse | steel sheet | 10 | " | 0.85 | 0.84 | 1.91 | — |
| 9 | Acceptable Example | pulse | ruby | 10 | " | 0.86 | 0.83 | 1.91 | — |
| 10 | Acceptable Example | pulse | " | 5 | " | 0.86 | 0.83 | 1.91 | — |
| 11 | Acceptable Example | continuous | sintered diamond | 10 | " | 0.87 | 0.85 | 1.90 | — |
| 12 | Acceptable Example | pulse | " | 10 | " | 0.88 | 0.86 | 1.90 | — |
| 13 | Comparative Example | none | iron needle under heavy pressure | 10 | " | 0.85 | 0.93 | 1.87 | 95 |
| 14 | Comparative Example | none | iron needle under light pressure | 10 | " | 0.87 | 0.89 | 1.89 | 96 |
| 15 | Comparative Example | none | laser | 10 | " | 0.84 | 0.91 | 1.90 | 97 |
| 16 | standard | — | — | — | — | — | 0.91 | 1.91 | — |

*Frequency: 28.5 kHz

EXAMPLE 2

A hot rolled sheet of silicon steel containing Si:3.05%, Mn:0.073%, Se:0.020% and Sb:0.025% was subjected to two-times cold rolling through an intermediate annealing at 950° C. to obtain a cold rolled sheet having a final thickness of 0.23 mm. Thereafter, the cold rolled sheet was subjected to decarburization and primary recrystallization annealing at 810° C. in a wet

TABLE 2

| | | Local removing treatment of oxide layer | | | | Iron loss value after treatment | | Magnetic properties after strain relief annealing followed by post-treatment | | Lamination factor |
|---|---|---|---|---|---|---|---|---|---|---|
| | | Generation mode of ultrasonic vibration* | Working tip | Working pitch (mm) | Working mode | $W_{17/50}$ (W/kg) | Post-treatment | $B_{10}$ (T) | $W_{17/50}$ (W/kg) | (%) |
| 1 | Acceptable Example | continuous | ruby | 10 | linear | 0.87 | Electrolytic etching | 1.91 | 0.84 | 97 |
| 2 | Acceptable Example | continuous | ruby | " | " | 0.86 | Electrolytic etching | 1.92 | 0.84 | |
| 3 | Acceptable Example | pulse | ruby | " | " | 0.86 | Electrolytic etching | 1.91 | 0.83 | |
| 4 | Acceptable Example | pulse | ruby | " | " | 0.87 | Electrolytic etching | 1.91 | 0.84 | |
| 5 | Acceptable Example | continuous | Electro-deposited | " | " | 0.88 | Electrolytic etching | 1.92 | 0.84 | |

TABLE 2-continued

| | | Local removing treatment of oxide layer | | | | Iron loss value after treatment | Post-treatment | Magnetic properties after strain relief annealing followed by post-treatment | | Lamination factor |
|---|---|---|---|---|---|---|---|---|---|---|
| | | Generation mode of ultrasonic vibration* | Working tip | Working pitch (mm) | Working mode | $W_{17/50}$ (W/kg) | | $B_{10}$ (T) | $W_{17/50}$ (W/kg) | (%) |
| 6 | Acceptable Example | continuous | diamond Electro-deposited diamond | " | " | 0.87 | Electrolytic etching | 1.92 | 0.83 | |
| 7 | Acceptable Example | pulse | Electro-deposited diamond | " | " | 0.87 | Electrolytic etching | 1.91 | 0.84 | |
| 8 | Acceptable Example | pulse | Electro-deposited diamond | " | " | 0.86 | Electrolytic etching | 1.91 | 0.83 | |
| 9 | Comparative Example | none | iron needle (under light pressure) | " | " | 0.88 | Electrolytic etching | 1.89 | 0.91 | 96 |
| 10 | Comparative Example | none | laser | " | " | 0.86 | Electrolytic etching | 1.90 | 0.89 | 97 |
| 11 | Comparative Example | none | scriber (under heavy pressure) | " | " | 0.87 | Electrolytic etching | 1.87 | 0.87 | 95 |

*Frequency: 28.5 kHz

EXAMPLE 3

A hot rolled sheet of silicon steel containing Si:3.25%, Mn:0.072%, Se:0.018% and Sb:0.025% was subjected to two-times cold rolling through an intermediate annealing at 950° C. to obtain a cold rolled sheet having a final thickness of 0.23 mm. Then, the cold rolled sheet was subjected to decarburization and primary recrystallization annealing at 820° C. in a wet hydrogen atmosphere, coated at its surface with a slurry of an annealing separator consisting mainly of MgO and coiled, which was subjected to a secondary recrystallization annealing in a box furnace at 850° C. for 50 hours and further to a purification annealing in a dry hydrogen atmosphere at 1200° C. for 10 hours.

After the removal of excessive annealing separator and the flat annealing, the sheet was subjected to a treatment for local removal of oxide layer under conditions as shown in the following Table 3. As the post-treatment, the electrolytic etching was carried out in an aqueous solution of NaCl (250 g/l) at a current density of 30 A/dm$^2$ for 10 seconds. Then, the resulting grooves were filled with a solution of borosiloxane, which was gradually heated to 200°-400° C. to conduct the baking. On the other hand, a part of the sheet was coated with antimony sol and dried at 100° C.

The iron loss values $W_{17/50}$ (W/kg) of the thus obtained sheets were measured to obtain results as shown in Table 3. Moreover, the standard sheet after the flat annealing had magnetic properties of $W_{17/50}$=0.92 W/kg and $B_{10}$=1.91 T.

TABLE 3

| | | Local removing treatment of oxide layer | | | | Iron loss value after treatment | Post-treatment (1) | Iron loss value after strain relief annealing | Post-treatment (2) | Iron loss value after strain relief annealing | Lamination factor |
|---|---|---|---|---|---|---|---|---|---|---|---|
| | | Generation mode of ultrasonic vibration* | Working tip | Working pitch (mm) | Working mode | $W_{17/50}$ (W/kg) | | $W_{17/50}$ (W/kg) | | $W_{17/50}$ (W/kg) | (%) |
| 1 | Acceptable Example | pulse | ruby | 10 | linear | 0.88 | electrolytic etching | 0.85 | — | — | 97 |
| 2 | Acceptable Example | pulse | ruby | 10 | point | 0.88 | — | 0.86 | — | — | |
| 3 | Acceptable Example | pulse | ruby | 5 | linear | 0.87 | electrolytic etching | — | borosiloxane | 0.82 | |
| 4 | Acceptable Example | pulse | Electro-deposited diamond | 10 | linear | 0.87 | electrolytic etching | 0.84 | — | — | |
| 5 | Acceptable Example | pulse | Electro-deposited diamond | 10 | point | 0.87 | — | 0.85 | — | — | |
| 6 | Acceptable Example | pulse | Electro-deposited diamond | 5 | linear | 0.88 | electrolytic etching | — | antimony sol | 0.82 | |
| 7 | Comparative Example | none | iron needle (under light pressure) | 5 | linear | 0.89 | electrolytic etching | 0.88 | — | — | 96 |
| 8 | Comparative Example | none | iron needle (under light pressure) | 5 | " | 0.89 | — | — | — | — | |
| 9 | Comparative | none | scriber (under heavy | 10 | " | 0.89 | — | — | — | — | 95 |

TABLE 3-continued

| | Local removing treatment of oxide layer | | | | Iron loss | | Iron loss value after | | Iron loss value after | |
|---|---|---|---|---|---|---|---|---|---|---|
| | Generation mode of ultrasonic vibration* | Working tip | Working pitch (mm) | Working mode | value after treatment $W_{17/50}$ (W/kg) | Post-treatment (1) | strain relief annealing $W_{17/50}$ (W/kg) | Post-treatment (2) | strain relief annealing $W_{17/50}$ (W/kg) | Lamination factor (%) |
| Example | | pressure) | | | | | | | | |

*Frequency: 28.5 kHz

EXAMPLE 4

TABLE 4

| | | Local removing treatment of oxide layer | | | | | Magnetic properties after the formation of insulation coating and the strain relief annealing | |
|---|---|---|---|---|---|---|---|---|
| | | Generation mode of ultrasonic vibration* | Working tip | Working pitch (mm) | Working mode | Iron loss value $W_{17/50}$ (W/kg) | Iron loss value $W_{17/50}$ (Wkg) | Lamination factor (%) |
| 1 | Acceptable Example | continuous | ruby | 10 | linear | 0.86 | 0.84 | 97 |
| 2 | Acceptable Example | continuous | ruby | 5 | " | 0.84 | 0.83 | |
| 3 | Acceptable Example | pulse | ruby | 10 | " | 0.85 | 0.83 | |
| 4 | Acceptable Example | pulse | ruby | 5 | " | 0.84 | 0.82 | |
| 5 | Acceptable Example | continuous | Electrodeposited diamond | 10 | " | 0.86 | 0.84 | |
| 6 | Acceptable Example | continuous | Electrodeposited diamond | 5 | " | 0.84 | 0.83 | |
| 7 | Acceptable Example | pulse | Electrodeposited diamond | 10 | " | 0.85 | 0.83 | |
| 8 | Acceptable Example | pulse | Electrodeposited diamond | 5 | " | 0.84 | 0.82 | |
| 9 | Comparative Example | none | iron needle (under light pressure) | 5 | " | 0.86 | 0.88 | 96 |
| 10 | Comparative Example | none | laser | 5 | " | 0.82 | 0.89 | 97 |

*Frequency: 28.5 kHz

A hot rolled sheet of silicon steel containing Si:3.28%, Mn:0.74%, Se:0.026%, sol.Al:0.027% and N:0.0083% was annealed at 1130° C. for 4 minutes, quenched and pickled.

Then, the sheet was subjected to a heavy cold rolling to obtain a cold rolled sheet having a final thickness of 0.23 mm. Thereafter, the cold rolled sheet was subjected to decarburization and primary recrystallization annealing in a wet hydrogen atmosphere at 840° C., coated at its surface with a slurry of an annealing separator consisting mainly of MgO and coiled, which was subjected to a secondary recrystallization annealing in a box furnace at 850° C. for 50 hours and further to a purificaton annealing in a dry hydrogen atmosphere at 1200° C. for 10 hours.

After the removal of excessive annealing separator and the flat annealing, the sheet was subjected to a treatment for the local removal of oxide layer under conditions as shown in the following Table 4.

The iron loss values $W_{17/50}$ (W/kg) of the thus obtained sheets were measured to obtain results as shown in Table 4. Moreover, the standard sheet after the flat annealing had magnetic properties of $W_{17/50}=0.89$ W/kg and $B_{10}=1.92$ T.

EXAMPLE 5

The oxide layer was locally removed from the surface of the grain oriented silicon steel sheet after the secondary recrystallization annealing have a thickness of 0.23 mm by linearly pushing a working tip of sintered diamond having a diameter of 1 mm to the sheet surface in a direction perpendicular to the rolling direction at a spacing of 8 mm. In this case, ultrasonic vibrations having a frequency of 25 kHz and an amplitude of 20 μm were applied to the working tip and the pushing pressure of the working tip was 10 kg/mm$^2$.

Similarly, the oxide layer was removed by using a working tip of super-hard alloy with a sharp point without application of ultrasonic vibration. In this case, a load of 10 kg/mm$^2$ was applied to the working tip.

After the removal of oxide layer, the electrolytic etching was carried out in an aqueous solution of NaCl (200 g/l) at a current density of 10 A/dm$^2$ for 8 seconds, and then the thus treated sheet was subjected to an Ni plating and further to a strain relief annealing (800°×2 hours). The magnetic properties of the thus obtained sheets are shown in the following Table 5.

TABLE 5

▲ degradation

| | | Conditions for local removal of oxide | | | | | |
|---|---|---|---|---|---|---|---|
| | | Application of ultrasonic vibrations | | | No application of ultrasonic vibration | | |
| | | after local removal | after etching | after strain relief annealing | after local removal | after etching | after strain relief annealing |
| no electrolytic | Δ $W_{17/50}$ (W/kg) | 0.05 | — | 0.06 | 0.04 | — | 0.02 |

TABLE 5-continued

| | | Conditions for local removal of oxide | | | | | degradation |
|---|---|---|---|---|---|---|---|
| | | Application of ultrasonic vibrations | | | No application of ultrasonic vibration | | |
| | | after local removal | after etching | after strain relief annealing | after local removal | after etching | after strain relief annealing |
| etching and filling | $\Delta B_{10}$ (T) | ▲0.005 | — | 0 | ▲0.03 | — | ▲0.02 |
| no filling after | $\Delta W_{17/50}$ (W/kg) | 0.05 | 0.06 | 0.07 | 0.04 | 0.04 | 0.02 |
| etching | $\Delta B_{10}$ (T) | ▲0.005 | ▲0.02 | ▲0.01 | ▲0.03 | ▲0.05 | ▲0.04 |
| filling after | $\Delta W_{17/50}$ (W/kg) | 0.05 | 0.06 | 0.08 | 0.04 | 0.04 | 0.04 |
| etching | $\Delta B_{10}$ (T) | ▲0.005 | ▲0.02 | ▲0.01 | ▲0.03 | ▲0.05 | ▲0.04 |

As mentioned above, according to the invention, grain oriented silicon steel sheets having a very low iron loss and not losing the effect of magnetic domain refinement even after strain relief annealing can be produced without causing the decreases of illumination factor and $B_{10}$ value which have never been avoided in the conventional technique.

What is claimed is:

1. A method of producing a low iron loss grain oriented silicon steel sheet from a silicon steel sheet having an oxide layer after secondary recrystallization annealing without substantial degradation of properties of said sheet when subjected to strain relief annealing, comprising the steps of:

(a) applying ultrasonic vibrations to a surface of said grain oriented silicon steel sheet after said secondary recrystallization annealing under conditions of limited pressure of not more than 40 kg/mm$^2$, (b) controlling the application of said ultrasonic vibrations to locally remove portions of said oxide layer having a width of 10–1000 um in the form of lines of dots or linear forms parallel to each other at a spacing of 1–30 mm from the surface of the sheet without substantially forming newly recrystallized grain groups on said surface; and (c) providing said ultrasonic vibration with a vibrating component effective in a direction perpendicular to said surface of the sheet, said ultrasonic vibration having a frequency of not less than 20 kHz and an amplitude of not more than 50 um.

2. The method according to claim 1, wherein after said local removal of oxide layer, an electrolytic etching is applied to said sheet.

3. The method according to claim 1, wherein after said local removal of oxide layer, electrolytic etching is applied to said sheet and then·a foreign substance is filled in said etched portions.

4. The method according to claim 1, wherein said local removal of portions of said oxide layer is carried out by applying ultrasonic vibrations in opposition to said surface of the sheet so as to reciprocatedly move in the widthwise direction of said sheet, staggeredly arranging plural ultrasonic vibrations toward and away from said surface of the running sheet in up and down directions thereof, applying each ultrasonic vibration to said surface of the sheet under a predetermined pressure while applying ultrasonic vibrations to said surface, and repeating the reciprocative movement of said vibrations, in the widthwise direction of said sheet to form removed portions on said surface of the sheet in a direction perpendicular to the rolling direction thereof at a given spacing.

5. The method according to a claim 4, wherein said vibrations are moved up and down in the running direction of said sheet in synchronization with the running speed of said sheet while being moved in the widthwise direction of said sheet.

6. The method according to claim 1, wherein said vibrations are applied from a material selected from the group consisting of diamond, ceramics, ruby and superhard alloy and has a needle-like form or a plate-like form.

7. The method according to claim 2, wherein the etching depth achieved by said electrolytic etching is not more than 20 um.

8. The method according to claim 3, wherein said foreign substance is selected from a group consisting of metal, silicate, phosphorus compound, oxide and nitride.

* * * * *

UNITED STATES PATENT AND TRADEMARK OFFICE

CERTIFICATE OF CORRECTION

PATENT NO. : 5,185,043

DATED : February 9, 1993

INVENTOR(S) : Ujihiro Nishike et al

It is certified that error appears in the above-identified patent and that said Letters Patent is hereby corrected as shown below:

Column 9, line 12, after "head" insert --portion 4 of--;
delete lines 13 and 14;
line 15, delete "is provided with plural".

Signed and Sealed this

Twenty-eighth Day of December, 1993

Bruce Lehman

*Attest:*

BRUCE LEHMAN

*Attesting Officer*

*Commissioner of Patents and Trademarks*